United States Patent [19]

Labruyerè

[11] 4,352,113

[45] Sep. 28, 1982

[54] FOLDABLE ANTENNA REFLECTOR

[75] Inventor: Gilles Labruyerè, Mandelieu, France

[73] Assignee: Societe Nationale Industrielle Aerospatiale, Paris, France

[21] Appl. No.: 277,857

[22] Filed: Jun. 26, 1981

[30] Foreign Application Priority Data

Jul. 11, 1980 [FR] France ..... 80 15527

[51] Int. Cl.[3] ..... H01Q 15/20

[52] U.S. Cl. ..... 343/915; 343/912

[58] Field of Search ..... 343/915, 840, 916, 912, 343/913, 914

[56] References Cited

U.S. PATENT DOCUMENTS

| | | | |
|---|---|---|---|
| 2,945,234 | 7/1960 | Driscoll | 343/915 |
| 3,530,469 | 9/1970 | Dailey et al. | 343/915 |
| 3,631,505 | 12/1971 | Tallmadge | 343/915 |
| 3,717,879 | 2/1973 | Ganssle | 343/915 |

*Primary Examiner*—David K. Moore

*Attorney, Agent, or Firm*—Merriam, Marshall & Bicknell

[57] ABSTRACT

The present invention relates to a foldable antenna reflector, particularly of large dimensions, for example adapted to fit out a telecommunications or direct television satellite.

According to the invention, said reflector has a structure comprising a plurality of arms, each of which is articulated at the end of a frame element remote from the axis of the reflector, so that, when said frame elements are in opened out position, said arms project angularly with respect thereto so that said structure forms a sort of cradle in the concavity of which is disposed said opened out supple dish and, when the frame elements are in collapsed position, said arms are folded along the side of said frame elements inside the cradle, so that said structure then forms a sort of bundle of small diameter enclosing said collapsed supple dish.

12 Claims, 6 Drawing Figures

FOLDABLE ANTENNA REFLECTOR

The present invention relates to an antenna reflector, particularly of large dimensions, for example adapted to fit out a telecommunications or direct television satellite.

It is known that, in this case, the main constraints imposed by the mission on such a reflector are:

the dimensions of the reflector in operational configuration exceeding by far the values allowed for storing the satellite under the cap of the launcher;

the tolerances allowed on the shape of the reflector for the whole duration of the mission are very small (+ or − a few tenths of mm with respect to a theoretical profile which may be a portion of a paraboloid of revolution);

the surface of the reflector is constituted by an electrically conducting material, for example a fabric whose meshes are smaller than a specified maximum (a few tenths of mm), in the case of a collapsible reflector.

U.S. Pat. No. 3,224,007 discloses an antenna reflector comprising an electrically conducting, supple dish constituted by wire netting. The majority of embodiments described therein comprise a rigid structure supporting said dish and tensioning members, for example cables, between the dish and the structure. Thus, by adjusting the length and tension of said members, it is impossible to adjust the shape of the supple dish to the desired shape and to respect the imposed tolerances. However, in this known embodiment, the rigid structure is fixed and the reflector could not be adapted to use on board a satellite. Thus, when the antenna of U.S. Pat. No. 3,224,007 must be applied to spatial uses, the author of said Patent has to eliminate said rigid structure, the supple dish then being rotated about its axis for it to maintain its shape of reflector, under the action of the centrifugal forces. Such a reflector cannot be energized in offset mode and the problems of inertia render it difficult to control the attitude of the carrier satellite.

Moreover, due to the fact that such a rotation requires drive means which increase the dimensioning, mass and cost of the whole, the rotation produces a certain floating of the dish. Furthermore, it becomes impossible to use tensioning members for adjusting the shape of the dish, since the rigid structure serving for anchoring said members is eliminated.

Collapsible reflectors are also known, such as the ones described in U.S. Pat. Nos. 3,496,687, 3,508,270 and 3,521,290.

U.S. Pat. No. 3,496,687 describes a reflector collapsible with the aid of arms and pantographs. This assembly therefore comprises numerous joints of which the clearances, when totalled, adversely affect the precision of the reflector. Moreover, when in collapsed position, the assembly is fairly bulky.

U.S. Pat. No. 3,508,270 describes a collapsible reflector made with the aid of wires stretched by an inflatable bladder element rigidified by cables stretches by a mast.

Such a reflector has the advantage of being of relatively small dimensions when in collapsed state, but cannot be suitable for very high frequency emissions, due to the dimensions of the meshes formed by the stretched wires, the number of which is necessarily restricted.

U.S. Pat. No. 3,521,290 describes a collapsible reflector of the "umbrella" type whose frame elements support rigid elements constituting parts of the reflector, which is formed, after said frame elements have been opened out, by the juxtaposition of said rigid elements. Such an assembly offers a good precision of the reflecting surface, but, when in collapsed state, is extremely bulky and has a fairly high mass.

It is an object of the present invention to provide an antenna reflector satisfying the above-mentioned constraints and overcoming the drawbacks of known embodiments.

In particular, when in collapsed state, it occupies an extremely reduced volume.

To this end, according to the invention, the antenna reflector comprises a supple conducting dish and a rigid structure supporting said dish, and is noteworthy in that said structure is constituted, on the one hand, by a plurality of frame elements converging towards the axis of the reflector and distributed about said axis, the ends of said frame elements close to this axis being articulated about axes tangential to a circle the plane of which is at right angles to said axis of the reflector, so as to be able to take a collapsed position along said axis of the reflector and an opened out position transverse with respect to this axis in the manner of the spokes of an umbrella and, on the other hand, by a plurality of arms, each of which is articulated at the end of a frame element remote from the axis of the reflector, so that, when said frame elements are in opened out position, said arms project angularly with respect thereto so that said structure forms a sort of cradle, in the concavity of which is disposed said opened out, supple dish and, when said frame elements are in collapsed position, said arms are also collapsed along the side of said frame elements inside the cradle so that said structure then forms a sort of bundle of small diameter enclosing the collapsed supple dish.

A collapsible antenna is thus obtained which does not necessitate any means for rotating it and which avoids any floating of the opened out dish, but which requires an actuating mechanism with a limited duration of operation. Furthermore, it is possible to use tensioning members allowing the adjustment of the shape of the reflector. In fact, the connection between the supple dish and the structure may be made, on the one hand, between the periphery of the dish and the free ends of said articulated arms and, on the other hand, by tensioning members disposed between the convex surface of the dish, and said frame elements.

The reflector according to the invention is therefore composed of three parts:

a supple conducting dish which constitutes the reflecting surface of the reflector;

a rigid, articulated, collapsible structure performing the following functions:

in launching configuration: of ensuring for the whole a geometry compatible with the space left available by the satellite inside the cap of the launcher, in orbital configuration: of constituting a reference solid with respect to which the supple dish will be located;

a set of adjustable tensioning wires connecting the supple dish to the rigid structure, and of which the tension and length are adjusted so as to bring the reflecting face of the dish as close as possible to the desired theoretical profile.

In addition to the advantages mentioned hereinabove, due to its design, the antenna reflector according to the invention presents the advantage of comprising a rigid structure to which may be adapted supple dishes of different diameters and curvatures. Thus, the same rigid structure may be used for obtaining reflectors of different focal distances, or reflectors which are offset and/or energized in offset manner.

Each frame element may be in one piece or, on the contrary, may be constituted by a plurality of collapsible sections.

In the case of the frame elements being in one piece, they advantageously present a trapezoidal section so that, the diameter of the circle to which their pivot axes are tangential being chosen accordingly, they may, in collapsed state, come into contact with one another, so that said bundle presents an at least substantially cylindrical closed outer surface. It is then advantageous if said arms also have a trapezoidal section so that, in collapsed position, they form an at least substantially cylindrical unit, determining the inner diameter of said bundle. Thus, when the structure is in collapsed state, the frame elements and the arms form a closed enclosure for the collapsed dish which is thus protected.

It will therefore be readily appreciated that a satellite equipped with at least one reflector according to the invention, in the collapsed state, may be mounted inside the cap of its launcher. After said satellite has been put into orbit, it is then necessary to open out said reflector. To this end, any known drive means may be provided (spring, electrical screw jack, pneumatic jack, etc . . . ) controlling the opening of the structure via a system of rods, for example. Whatever the driving means chosen, it may actuate a mobile member sliding along the axis of said reflector and to which are connected all of said rods. Thus, the frame elements open simultaneously.

Furthermore, to connect the reflector according to the invention to the satellite or to an arm articulated on the satellite, it is advantageous to provide a hollow base, coaxial with respect to the axis of the reflector, on which said frame elements are articulated, and inside which the mechanism for opening the reflector is at least partly housed.

Opening combining means are preferably provided, such as cables and rollers connecting each frame element and the arm associated therewith, so that, when the actuating mechanism passes said frame elements from their collapsed position to their opened out position, said arms pass automatically and progressively from their collapsed position along the inner side of the frame elements to their angularly projecting position.

For the angularly projecting position of the arms to be well determined with respect to the frame elements, stop systems are provided between these elements.

Furthermore, the opening out of the assembly according to the invention is reversible, if only to proceed with tests before the artificial satellite carrying said assembly is launched. To this end, means for returning into collapsed position are provided.

The invention will be more readily understood on reading the following description with reference to the accompanying drawings, in which:

FIG. 1 schematically illustrates, in side view, the launching and orbital position and configuration of a reflector according to the invention mounted on a satellite.

Figure 5:
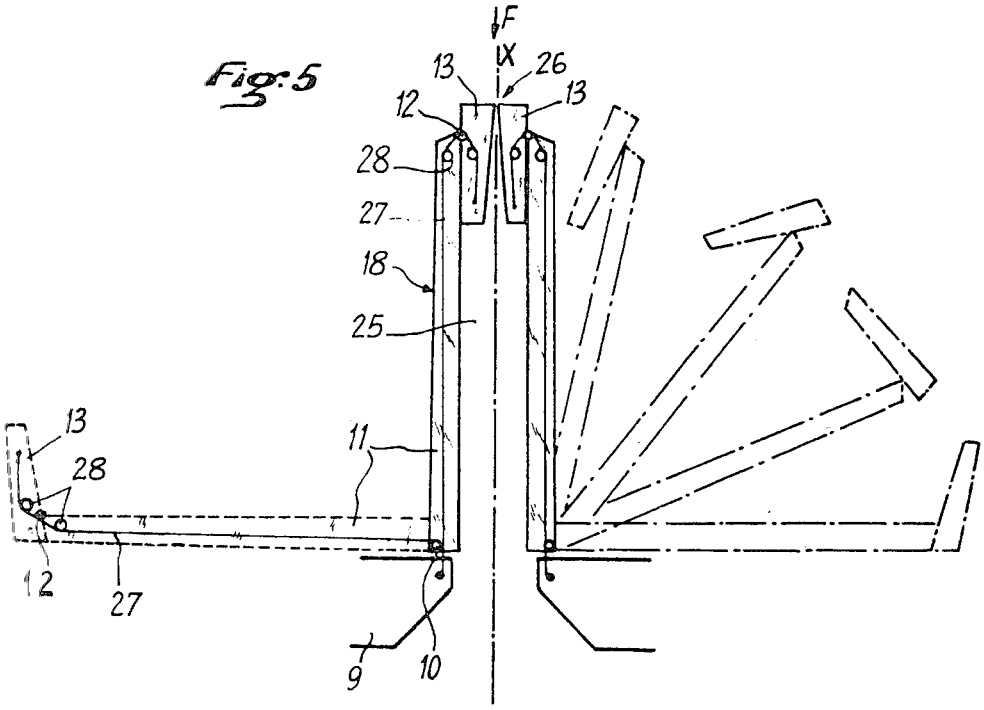

FIG. 5 schematically illustrates the opening out of the frame elements and of the arms.

Figure 6:
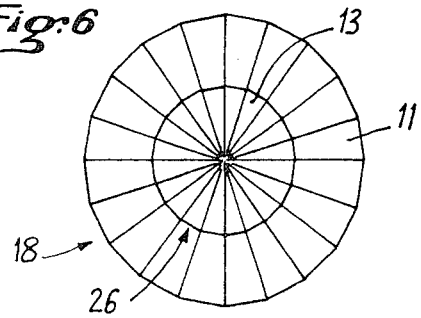

FIG. 6 is an enlarged end view, in the direction of arrow F of FIG. 5, of the structure of the reflector according to the invention, in collapsed position.

Figure 1:
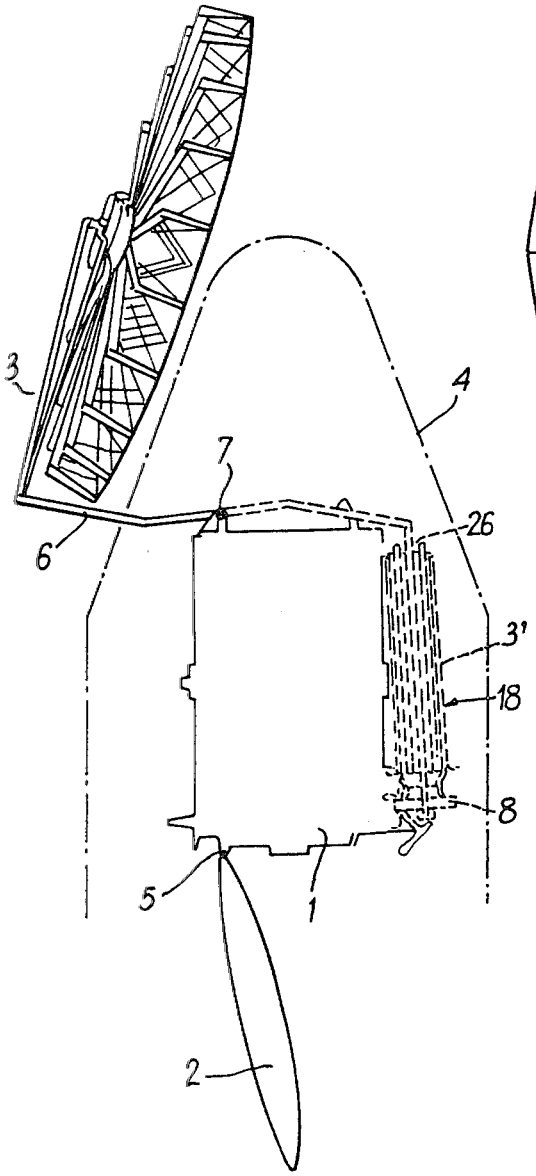
Figure 2:
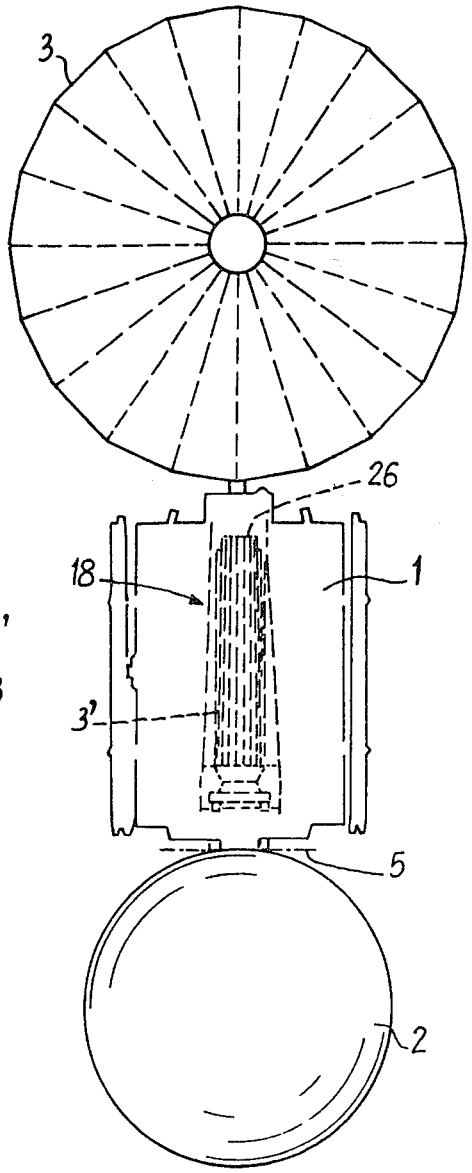
FIG. 2 is a front view corresponding to FIG. 1, the cap of the launcher no longer being shown.

Referring now to the drawings, FIGS. 1 and 2 show an artificial satellite 1 equipped with a small reflector 2 of fixed dimensions and with a collapsible reflector 3 according to the invention, of large dimensions.

During launching, the satellite 1 is disposed inside the cap 4 of a launcher and the reflectors 2 and 3 are folded against the body of the satellite. In FIGS. 1 and 2, the folded position of the reflector 2 has not been indicated, whilst that of reflector 3, shown in dashed lines, bears reference 3'.

When the satellite is in orbit (configuration illustrated in FIGS. 1 and 2), the reflectors 2 and 3 are opened out and occupy the positions indicated in solid lines. It will be noted that, to this end, the reflector 2 is simply rotated about a pivot pin 5 connecting it to the body of the satellite, whilst the reflector 3, in addition to a rotation of its support arm 6 about an axis 7, enabling it to be moved away from the body of the satellite 1, undergoes an opening action and rotation about a pin 8 connecting it to said support arm 6.

Figure 3:
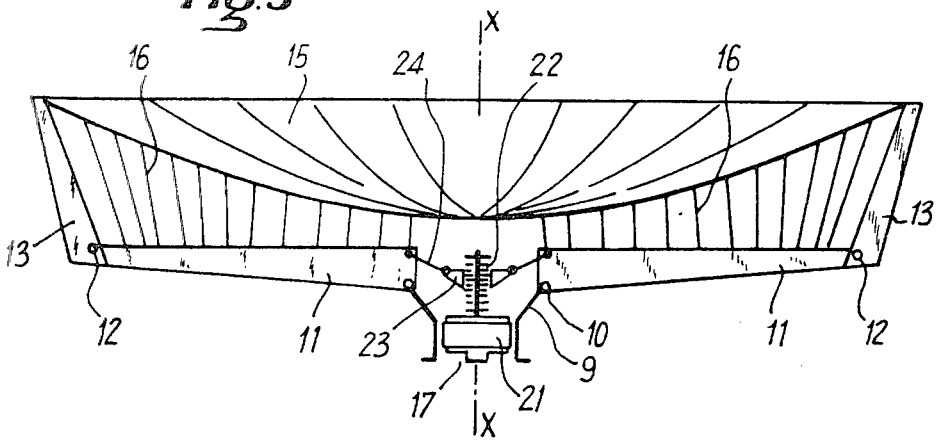
FIG. 3 illustrates, in diametrical section, the reflector according to the invention in opened out position.
Figure 4:
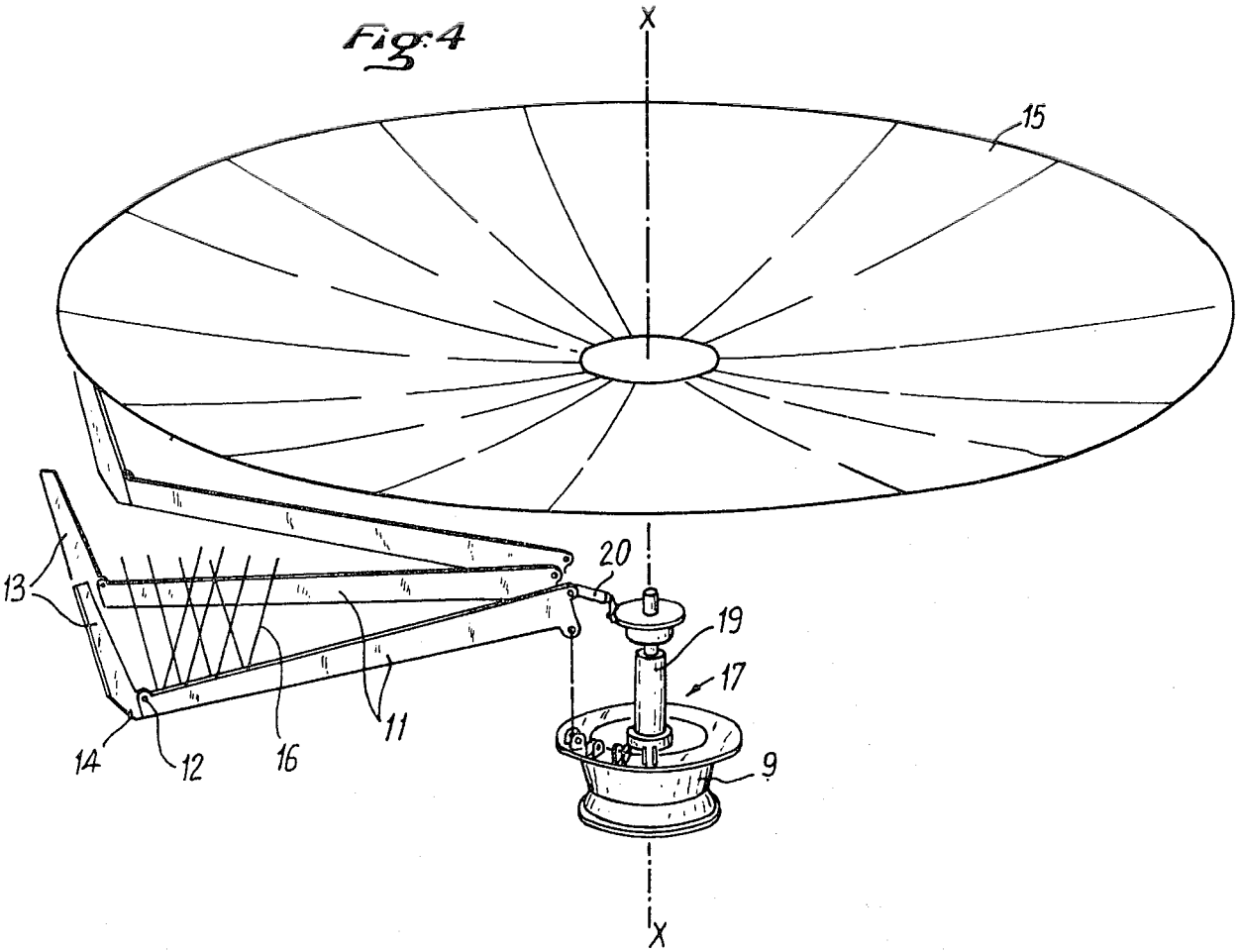
FIG. 4 is a partial exploded view of an embodiment of the reflector according to the invention, in opened out position.

As is more clearly illustrated in FIGS. 3 and 4, the collapsible reflector according to the invention presents a structure preferably of revolution about its axis X—X and comprises a solid base 9, fixed to the end of the arm 6 and on which are articulated, about axes 10, a plurality of radial frame elements 11. At the end of the frame elements 11 opposite the axes 10 are articulated arms 13, about axes 12 at right angles to the frame elements 11, said arms being adapted to pivot between a position for which they are folded between said frame elements and a position for which they are transverse with respect thereto (cf. FIG. 5), this latter position being determined for the cooperation of a stop 14 fast with said arms with the end of said frame elements. The periphery of a supple reflecting dish 15 is rendered fast (directly or via tensioning ties) with the free ends of the arms 13, whilst tensioning wires 16 are provided between the convex face of the dish 15 and the frame elements 11. A reversible actuating mechanism 17 enables the opening out action of the frame element 11 and of the arms 13 to be controlled.

The reflecting dish 15 must be a good conductor of electricity, supple, dimensionally stable, light, resistant and must have a low coefficient of expansion. It may be made for example in the form of a woven or knitted fabric whose weave or knit characteristics give the suppleness and whose constituent materials determine the stability, heat expansion and conductivity. The materials used for making this woven or knitted fabric may either be metallic (molybdenum, chromel R, . . . ) or synthetic and coated in known manner with a metal (such as for example a gold-plated polyester yarn). The yarn for weaving or knitting is advantageously constituted by a plurality of strands (up to 300) and it may be twisted to reduce its flexural rigidity. Its diameter is preferably very small (of the order or 50$\mu$) and the mesh diameter is compatible with the wave length used.

In an advantageous embodiment, a wire of gold-plated molybdenum is used for making the dish 15, having a diameter of 50$\mu$ and constituted by three twisted strands. This yarn is knitted in moss stitch, the meshes having a diameter of 0.7 mm.

From the flat knit thus produced, pseudo-triangular gores are cut out and are assembled by sewing, gluing or welding to form the dish. This dish is stretched inside the cradle constituted by the opened out structure 11,13, for example by positioning tensioners (not shown) between points distributed on its periphery and the free end of the arms 13.

Said dish may also be made of a supple, homogeneous and isotropic material, metal-coated on the surface or internally by inclusion of conducting pulverulent fillers.

For example, it may be made with the aid of a foil of elastomer charged with particles of gold or silver, or with the aid of a foil of aluminium-coated "milar".

According to a particular embodiment of the invention, said dish may comprise in its central part a rigid dome of small diameter ensuring continuity of the reflector profile and rendered fast with the base 9.

Said rigid dome is also rendered fast with the supple part of the dish. It has the following advantages:

it constitutes a rigid bottom for the volume formed by the collapsed reflector, thus avoiding the conducting skin being in contact with the opening out mechanisms.

it geometrically stabilises the remaining part of the parabola, ensuring therefor a strictly fixed position at its centre with respect to the frame elements and the arms, and replaces the wires for shaping the heart of the reflector, it easily finds its place inside the cylinder formed by the collapsed frame elements, it may itself serve as support for a primary source-bearing or primary reflector-bearing tower if the system used is of the "Cassegrain" or "Gregory" type. In the latter case, it also supports the primary source of which the opening is located substantially near its summit.

The frame elements 11 are rectilinear beams of closed section. They may be made of carbon fibres and may have a trapezoidal section to present minimum dimensions in collapsed position (cf. FIGS. 5 and 6), and maximum inertias of flexion and of torsion. Thus, in this position, the beams 11 may form a tube with facets 18, of which the inner cavity 25, determined by the cylinder 26 formed by the collapsed arms 13, encloses the dish 15 (not shown in FIG. 5).

The arms 13 are made similarly to frame elements 11. The opening out actions of the arms 13 are preferably combined with those of the frame elements. Such a combination of movements may be obtained by means of a system with cable 27 and pulleys 28, said cable being anchored on the base 9.

Means for returning the arms 13 on the frame elements 11 may be constituted by leaf springs (not shown in FIG. 3). Another means for returning the arms 13 on the frame elements 11 may be obtained by doubling the cables 27 by cables of substantially equal length but following an opposite path with respect to the articulations 10 and 12 (FIG. 5).

The actuating mechanism 17 must present the following characteristics:

slow, regular opening of the reflector 11,13,15;

considerable end-of-opening energy to ensure the tension of the dish 15 and locking or maintaining of the assembly in opened out position due to locking or stop means (not shown).

reliability and reproducibility of the positioning of the frame elements and the arms.

Depending on the dimensions of the reflector, different actuating mechanisms may be used:

spring with regulation device (not shown)

double-acting pneumatic jack 19 controlling the frame element 11 via rods 20 (cf. FIG. 4);

reversible electric motor 21 rotating a screw 22 on which moves a nut 23, controlling the frame elements 11 via rods 24 (cf. FIG. 3)

electrical disconnect capstan and cables.

The reflecting surface of the dish 15 in accordance with the theoretical profile of the reflector is shaped by adjusting the length of the tensioning wires 16.

The wires 16 are stretched between points distributed judiciously and, for example, uniformly on the dish 15 and points distributed on the frame elements 11, the structure 11,13 being considered as being very rigid with respect to the fabric of the dish 15.

The length of the wires 16 may be adjusted as follows:

manufacture of the wires to size. After measuring the dish and the structure 11,13 under stress, the length of each wire 16 is determined by calculation. One end of each wire is attached to the convex face of the dish 15, the other end being attached to a frame element 11.

fitting by adjustment: Beneath the frame elements 11 are mounted adjusting devices (not shown) (one per wire) allowing the wire's length to be precisely adjusted after overall control of the surface. After adjustment, the wire is attached to the frame element, cut between the point of adhesion and the adjusting device and this device is dismantled.

a mixed solution consists in cutting each wire with a mean tolerance (~0.5 mm), then in adjusting it very precisely, but over a small range (1 or 2 mm).

In the folded position 3', each frame element 11 occupies a position substantially parallel to axis X—X and the corresponding arm 13 is folded against the face of said frame element directed towards this axis (cf. FIGS. 5 and 6). Consequently, the frame element 11 all form a quasi-cylindrical, tubular bundle 18 of which the inner diameter is determined by the arms 13 which are in contact with one another. The supple dish 15 is then enclosed in the space 25 inside the bundle 18, defined by the frame elements 11 and the arms 13. When the actuating mechanism 17 acts, displacing a mobile member such as 23 along the axis X—X, the frame elements 11 open like the spokes of an umbrella under the action of the rods 20 or 23 (cf. the right-hand part of the FIG. 5), whilst the arms 13 open out progressively, rotating about the articulations 10, under the action of the movement combining cables 27. In maximum open position, the frame elements form a substantially flat star, the arms 13 are in upright position and the dish 15 is stretched.

Although in the assembly shown the frame elements 11 and arms 13 are in one piece, it is obvious that they might be constituted by a plurality of collapsible sections, this enabling the surface of the reflector of the invention to be further increased, with smaller dimensions in the collapsed state.

It is therefore seen that, according to the invention, a light, collapsible structure 11,13 is made, which may be considered as virtually undeformable under limited variations of stresses (creeping) and temperature. Such a structure makes it possible to maintain a dish 15, whose shape is independent from said structure and may be adapted as best possible to the mission to be fulfilled, for example of parabolic shape of revolution, centred or offset in the case of an antenna with offset illumination.

The invention therefore enables identical structures to be made for dishes of different shapes.

What is claimed is:

1. An antenna reflector comprising a supple reflecting dish, and a collapsible, rigid support structure supporting said dish, said structure comprising:

a central base;

a plurality of elongated frame elements radially distributed about said base, one end of each of said elements being articulated to said base about an axis tangential to a circle in a plane perpendicular to the axis of reflection of said dish, said frame elements being movable between a collapsed position generally parallel to said axis of the dish and an extended position transverse thereto;

a plurality of arms, each of which has one free end and one end articulated to the other end of a frame element, each arm being movable from a first position in which it projects angularly with respect to its associated frame element and a second position in which it is folded adjacent the side of said frame elements facing said axis of the dish;

means for moving said frame elements between said collapsed and extended positions;

means for causing said arms to assume said first position when said frame elements are extended and said second position when said frame elements are collapsed;

means for connecting the periphery of said dish to the free ends of said arms;

means including tensioning members extending between said dish and said frame elements for causing said dish to assume a desired configuration when said frame elements are extended;

said frame elements, when collapsed, forming a generally tubular bundle of relatively small diameter enclosing said supple dish.

2. The reflector of claim 1, wherein said dish has the form of a portion of paraboloid and the axis of said paraboloid is offset with respect to the axis of said base.

3. The antenna reflector of claim 1, wherein each frame element is made of one piece.

4. The antenna reflector of claim 1, wherein each frame element is constituted by a plurality of sections which are collapsible and which can be opened out.

5. The antenna reflector of claim 1, wherein the frame elements are rectilinear and have a trapezoidal section so that, the diameter of the circle to which their pivot axes are tangential being chosen accordingly, they may, in collapsed position, come into contact with one another, so that said bundle presents an at least substantially cylindrical closed outer surface.

6. The antenna reflector of claim 5, wherein said arms also present a trapezoidal section so that, in collapsed position, they form an at least substantially cylindrical unit, determining the inner diameter of said bundle.

7. The antenna reflector of claim 1, comprising an actuating mechanism, wherein said mechanism comprises a mobile member sliding along the axis of said reflector and to which are connected a plurality of rods each connected to one of said frame elements.

8. The antenna reflector of claim 1, wherein opening combining means are provided for connecting each frame element to the arm associated therewith so that, when the frame elements pass from their collapsed position to their extended position, said arms pass automatically and progressively from their folded position along the inner side of the frame element to their angularly projecting position.

9. The antenna reflector of claim 1, wherein the angularly projecting position of the arms with respect to the frame elements is determined by the cooperation of stops between each frame element and each arm.

10. The antenna reflector of claim 8, wherein said actuating and combined opening means are reversible.

11. The reflector of claim 1, wherein the central part of said dish is rigid and fast with said base.

12. The antenna reflector of claim 7 wherein said base is hollow and coaxial to said axis of the dish, and said actuating mechanism is at least partially housed within said base.

* * * * *